US006811636B2

(12) United States Patent
Hebels et al.

(10) Patent No.: US 6,811,636 B2
(45) Date of Patent: Nov. 2, 2004

(54) PROCESS AND MACHINE FOR SPLICING RUNNING WEBS OF PAPER AND THE LIKE

(75) Inventors: Albert-Berend Hebels, Hamburg (DE); Frank Grothaus, Hamburg (DE); Franz Hartmann, Geesthacht (DE)

(73) Assignee: HAUNI Maschinenbau Aktiengesellschaft, Hamburg (DE)

( * ) Notice: Subject to any disclaimer, the term of this patent is extended or adjusted under 35 U.S.C. 154(b) by 0 days.

(21) Appl. No.: 10/635,016

(22) Filed: Aug. 6, 2003

(65) Prior Publication Data

US 2004/0060653 A1 Apr. 1, 2004

(30) Foreign Application Priority Data

Aug. 14, 2002 (EP) ..... 02018339
Aug. 14, 2002 (EP) ..... 02018340

(51) Int. Cl.[7] ..... B65H 21/00

(52) U.S. Cl. ..... 156/157; 156/504; 156/502; 242/554; 242/554.5; 242/554.6; 242/555; 242/556

(58) Field of Search ..... 242/551, 554, 242/554.5, 554.6, 555, 556; 156/157, 159, 502, 504

(56) References Cited

U.S. PATENT DOCUMENTS 3,061,220 A * 10/1962 Gagg et al. ..... 242/553
3,089,661 A 5/1963 Phillips, Jr. et al.
3,252,671 A * 5/1966 Phillips, Jr. et al. ..... 242/553
3,856,227 A 12/1974 Gouy
4,236,538 A * 12/1980 Foster et al. ..... 131/370
5,060,665 A 10/1991 Heitmann
5,072,742 A 12/1991 Heitmann
5,135,008 A 8/1992 Oesterling et al.
5,360,502 A * 11/1994 Andersson ..... 156/159
5,442,897 A 8/1995 Hinzmann et al.
5,526,826 A 6/1996 Heitmann
6,030,496 A 2/2000 Baggot et al.
6,051,095 A 4/2000 Butterworth
6,578,616 B2 * 6/2003 Stein et al. ..... 156/504

FOREIGN PATENT DOCUMENTS

DE 1 995 937 8/1968
DE 1 532 203 1/1970
DE 1 532 204 1/1970
DE 693 00 282 T2 3/1996
DE 100 43 984 A1 3/2001
DE 100 12 000 A1 9/2001

* cited by examiner

*Primary Examiner*—Mark A. Osele
(74) *Attorney, Agent, or Firm*—Venable LLP.; Robert Kinberg

(57) ABSTRACT

The invention relates to a process and to a machine for splicing the trailing end of a running expiring web (e.g., a web of cigarette paper) to the leading end of a fresh web while the ends of the webs travel next to each other, in the same direction and at an at least substantially identical speed between a rotary knurling surface and a complementary second rotary surface which may but need not be a knurling surface. The rolls which constitute or mount the carriers for the two surfaces are driven in such a way that each n-th (e.g., each tenth) revolution results in the making of a splice between the leading and trailing ends of the webs. The forwardly and/or rearwardly extending remnants of the fresh and expiring webs are torn off the spliced-together webs at the respective ends of the splice.

30 Claims, 12 Drawing Sheets

369°

3575°

3589P

3599P

PROCESS AND MACHINE FOR SPLICING RUNNING WEBS OF PAPER AND THE LIKE

CROSS-REFERENCE TO RELATED CASES

This application claims the priorities of the commonly owned copending European patent applications Serial Nos. 02 018 340.6 and 02 018 339.8, both filed Aug. 14, 2002. The disclosures of the above-referenced European patent applications, as well as that of each U.S. and/or foreign patent and/or patent application identified in the specification of the present application, is incorporated herein by reference.

The invention which is disclosed in the present application is similar to that disclosed in the copending U.S. patent application Ser. No. 10/635,020, filed Aug. 6, 2003 by Albert-Berend HEBELS, Frank GROTHAU, Franz HARTMANN and Jens COLLIN for "METHOD OF AND APPARATUS FOR SPLICING RUNNING WEBS OF PAPER AND THE LIKE".

BACKGROUND OF THE INVENTION

This invention relates to improvements in processes and in machines, for splicing together running webs of paper or the like, e.g., webs or strips of paper or other wrapping material for use in the making of plain or filter cigarettes, cigars, cigarillos and/or other rod-shaped smokers' products. More particularly, the invention relates to improvements in processes and machines for splicing trailing ends of lengthwise moving expiring webs or strips of paper or the like to leading ends of lengthwise advancing fresh webs in such a way that the leading and trailing ends need not be adhesively and/or thermally secured to each other. Still more particularly, the instant invention relates to improvements in processes or methods and in machines for securing the leading and trailing ends of pairs of running webs or strips of deformable material to each other while the two ends advance lengthwise, in the same direction, adjacent one another, at or close to identical speeds and are pressed against each other. Splicing undertakings of such character include folding and knurling.

Processes and apparatus or machines for splicing the leading ends of fresh running webs to the trailing ends of expiring running webs are resorted to, among other undertakings, in the tobacco processing industry, e.g., to connect the leader of a rotating fresh bobbin or reel of convoluted cigarette paper or other strip- or web-shaped deformable wrapping or confining material to the trailing end of a rotating nearly expired or exhausted bobbin or reel of wrapping material in such a way that the delivery of wrapping material to the wrapping station of a cigarette maker or another web processing or consuming machine need not be interrupted or decelerated. This greatly reduces the number of rejects and enhances the output, especially in certain modern high-speed web processing machines which are designed to turn out well in excess of 10,000 rod-shaped smokers' products or the like per minute.

Presently known methods or processes and machines or apparatus of the above outlined character are disclosed, for example, in the assignee's German patent No. 693 00 282, German Utility Model No. 1 995 937 and published German patent applications Serial Nos. 1 532 203 and 1 532 204. U.S. Pat. No. 3,089,661 (granted May 14, 1963 to Malcolm E. Phillips, Jr. et al.) discloses an automatic cigarette paper splicer wherein a fresh convoluted cigarette paper web is accelerated to the speed of a running (expiring) cigarette paper web by taking into consideration the mass of the supply (such as a bobbin) of fresh convoluted web, the speed of the expiring bobbin of convoluted web and the tensional strength of the webs. Two rotary splicing sectors are provided to connect the leading end to the trailing end when the speed of the leading end matches that of the trailing end as well as the peripheral speeds of the two sectors. The splicing involves or can involve one revolution of each sector about its respective axis. The final steps of the Patented ed splicing operation include the severing of those (foremost and rearmost) ends of the spliced-together webs which respectively extend forwardly and rearwardly of the finished splice. Such final steps are carried out by resorting to knives which are actuated in dependency upon the positions of the splicing sectors.

An advantage of the automatic splicer which is disclosed in the U.S. Pat. No. 3,089,661 to Phillips et al. is that the operation of the web processing apparatus or machine (e.g., a machine which confines a continuous rod-like filler or natural, substitute or reconstituted tobacco in a continuous web of cigarette paper or the like) need not be interrupted when the supply of a reel of convoluted web-like or strip-like wrapping material is exhausted, i.e., that the splicing operation can be carried out while the expiring web and the fresh web are being moved at the prescribed speed of the wrapping material entering the processing machine.

Another presently known mode of splicing the leader of a fresh web to the trailing end of a moving expiring web in a cigarette maker is to resort to a magazine which is designed to temporarily store a length of the expiring web. Such proposals are not entirely satisfactory because the magazine takes up a substantial amount of space in a cigarette making or like plant wherein hundreds of wrapping machines are confined in a common hall, i.e., wherein the hall must accommodate a discrete magazine for each wrapping machine.

OBJECTS OF THE INVENTION

An object of the instant invention is to provide a novel and improved process for splicing the running trailing end of an expiring web of paper or the like to the running leader of a fresh web in a novel and improved manner, particularly or at least as concerns the appearance, the uniformity and the strength of the splices.

Another object of our present invention is to provide a process which can be practiced with advantage in connection with the making of wrapped tobacco products and which can be carried out without resorting to magazines or similar bulky facilities for temporary storage of looped and/or otherwise deformed webs of wrapping material.

A further object of the invention is to provide a novel and improved machine or apparatus for the practice of the above outlined process.

An additional object of our invention is to provide the machine with a novel and improved mechanism for making a pressure splice between the continuously advancing trailing end of an expiring web of paper or the like and a continuously advancing leading end of a fresh web.

Still another object of this invention is to reduce the number of rejects among the products which are obtained by draping a composite running web of paper or the like around a rod-shaped tobacco filler and/or filter material for tobacco smoke or the like.

A further object of this invention is to provide a novel and improved process as well as a novel and improved arrangement for trimming the front and/or rear ends of splices between selected portions of an expiring web and a fresh web of paper or other wrapping material.

Another object of the invention is to provide a novel and improved process and a novel and improved machine or apparatus of the above outlined character which can be incorporated into or otherwise combined with presently known processes and/or machines for wrapping commodities into and/or for otherwise associating commodities with continuous running webs of paper, plastic material or the like.

An additional object of the present invention is to provide a novel and improved system for regulating the operation of motors and/or other prime movers in a machine of the above outlined character.

Still another object of the invention is to provide a novel and improved cigarette making or other tobacco processing machine which cooperates with or embodies a machine of the above outlined character.

A further object of the invention is to provide a web splicing machine which is constructed and assembled in such a way that it allows for convenient threading of fresh webs into their prescribed path and for readily observable advancement of successive webs of paper or the like to the web processing or consuming station.

SUMMARY OF THE INVENTION

One feature of this invention resides in the provision of a process for splicing the trailing end of an expiring running web (e.g., of cigarette paper or the like) to the leading end of a fresh running web. The improved process comprises the steps of advancing the leading and trailing ends of the webs in at least substantial parallelism with and next to each other at an at least substantially identical speed along a path which is flanked by a rotary knurling surface and a rotary countersurface, and rotating the surfaces at different speeds through a majority of a plurality of revolutions. The revolutions include an n-th revolution during which the surfaces are sufficiently close to each other to splice the trailing end to the leading end in the path. Furthermore, n is greater than one.

The rotating step can include maintaining the speeds of the knurling surface and the countersurface at least close to the substantially identical speed of the webs in their path in the course of the n-th revolution. The process can be carried out in such a way that n is at least close to ten revolutions. Furthermore, the ratio of the different speeds can equal or approximate 10:11.

The process can further comprise the step of bringing one of the surfaces into contact with one of the webs in the path only in the course of the n-th revolution; such one surface can constitute the knurling surface.

The rotating step can further include rotating the surfaces at an at least substantially identical speed in the course of the n-th revolution.

The positions of the leading and trailing ends of the two webs can be selected in such a way that the rotating step entails the provision of at least one remnant which develops in the course of the n-th revolution and is of one piece with one of the webs; the improved process then preferably further includes the step of separating the at least one remnant from the spliced-together webs. Such separating step preferably includes moving the at least one remnant at a speed other than the at least substantially identical speed of the webs in their path.

If the rotating step entails the provision of a remnant of the expiring web, the separating step can include reducing the speed of the remnant below the at least substantially identical speed of the webs in their path. Such speed reducing step preferably includes braking the remnant of the expiring web.

If the rotating step entails the provision of a remnant at the fresh web and such remnant extends forwardly of the splice, the separating step preferably includes accelerating the remnant to a speed above the at least substantially identical speed of the webs in their path. Such accelerating step can be carried out during one of the stages including (a) simultaneously with the splicing of the webs to each other, and (b) subsequent to the splicing.

Another feature of the instant invention resides in the provision of a machine for splicing the trailing end of an expiring running web (e.g., a web of cigarette paper or the like) to the leading end of a fresh running web while the leading and trailing ends advance next to each other, in the same direction and at an at least substantially identical speed. The improved apparatus comprises a rotary knurling member which is adjacent one side of the path for the webs, a rotary splicing member adjacent the other side of the path for the webs at least substantially opposite the knurling member, regulatable drive means for the rotary members, and means for regulating the drive means to rotate the two members at different speeds through a majority of a plurality of revolutions including an n-th revolution during which the members are sufficiently close to each other to splice the trailing end of the expiring web to the leading end of the fresh web in the aforementioned path. In accordance with a desirable feature of the machine, the number n is greater than one (e.g., 10).

The knurling member can be provided with a peripheral knurling surface and the splicing member can be provided with a peripheral countersurface which cooperates with the knurling surface to splice the leading and trailing ends of the webs in their path to each other in the course of the n-th revolution of the aforementioned plurality of revolutions. The drive means can include means for rotating the knurling and splicing members about spaced-apart at least substantially parallel axes. At least one of the members can include a segment which is arranged to orbit about the respective axis, and the means for rotating can include a roll which is rotatable about the respective axis and has a peripheral surface bearing the segment.

Alternatively, the means for rotating the two members can include two rolls each of which is rotatable about a different one of the spaced-apart at least substantially parallel axes. The knurling member of such machine can include a first segment which is borne by one of the rolls, and the splicing member can include a second segment which is borne by the other roll. The two axes can be spaced apart from each other a distance which is required to ensure that the segments compress the webs in their path and thus splice the webs to each other only during the n-th revolution of the aforementioned plurality of revolutions.

The improved machine can be set up to splice the trailing end of an expiring web to the leading end of a fresh web in such a way that at least one of the webs includes a remnant which extends beyond the spliced-together portions of the webs in their path. Such machine preferably further comprises means for separating the remnant from the at least one web not later than upon completed splicing of the webs to each other.

The separating means can include means for tearing the remnant from the at least one web, and such tearing means can include means for changing the speed of the remnant and of the spliced-together portions of the webs relative to each other. The just described machine can be designed in such a way that each of the two members has a knurling surface, and the drive means can comprise a rotary roll for each of the two members. The rolls are rotatable about at least substantially parallel axes, and the member borne by at least one of the rolls can include a segment which is provided on the peripheral surface of the at least one roll.

If the remnant forms a rearwardly extending part of the trailing end of the expiring web, then the aforementioned speed changing means of the tearing means can include a brake which is operable by the regulating means to decelerate the remnant not later than upon the splicing of leading and trailing ends of the two webs to each other. This results in tearing of the remnant off the expiring web along the trailing edge of the splice between the two webs.

Alternatively, or in addition to the provision of a remnant which extends rearwardly of the freshly formed splice, the splicing operation can result in the provision of a remnant which forms a forwardly projecting part of the leading end of the fresh web. The speed changing means of the tearing means then includes or can include means for raising the speed of the forwardly projecting remnant relative to the spliced-together portions of the web. Such speed changing means can form part of a means (e.g., a variable-speed electric motor and a pair of rollers driven by such motor) for advancing the fresh web in the aforementioned direction.

The novel features which are considered as characteristic of the invention are set forth in particular in the appended claims. The improved machine itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
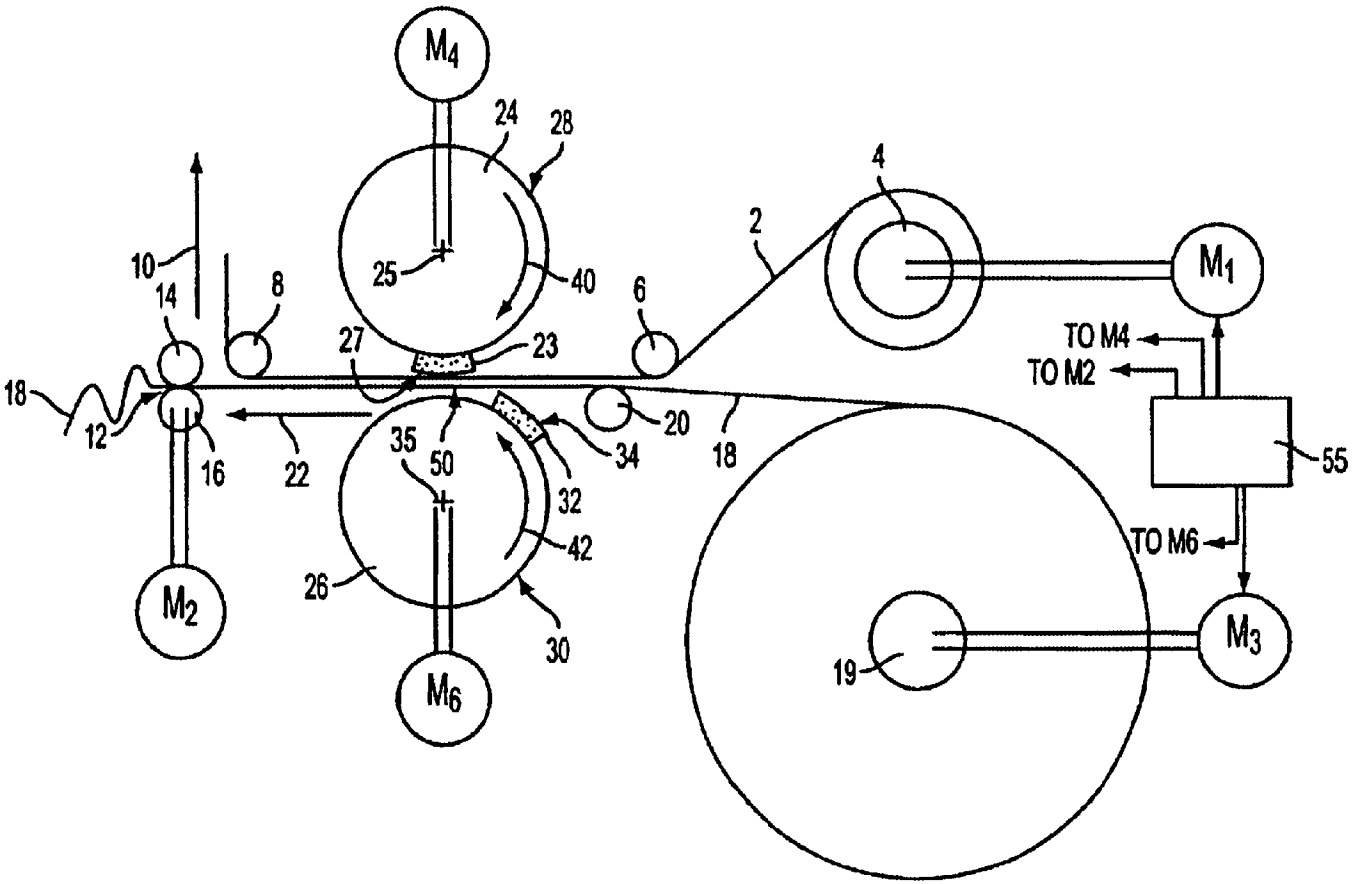
FIG. 1 is a partly schematic elevational view of a splicing machine wherein the leading end of a fresh running web of paper or the like and the trailing end of an expiring running web can be spliced to each other between two orbiting convex knurling surfaces.

FIG. 1 illustrates certain component parts of a machine wherein the trailing ends of successive expiring webs of cigarette paper, tipping paper (e.g., for the making of filter cigarettes of double unit length in a manner as disclosed in commonly owned U.S. Pat. No. 5,135,008 granted Aug. 4,1992 to Erwin Oesterling et al. for "METHOD OF AND APPARATUS FOR MAKING FILTER CIGARETTES") or other foldable wrapping material are spliced to the leading ends of successive fresh webs of such material. The expiring web 2 which is shown in FIG. 1 is supplied by a bobbin or reel 4 having a core driven by a first drive means here shown as a variable-speed electric motor M1 controlled by a schematically illustrated control unit 55. The leader (not shown) of the expiring web 2 is drawn in the direction of arrow 10 by a suitable drive means of a processing or consuming machine (not shown), e.g., by two driven rollers in the wrapping unit of a cigarette making machine such as that disclosed in commonly owned U.S. Pat. No. 5,060,665 (granted Oct. 29, 1991 to Uwe Heitmann for "WRAPPING MECHANISM FOR ROD MAKING MACHINES OF THE TOBACCO PROCESSING INDUSTRY"), in commonly owned U.S. Pat. No. 5,072,742 (granted Dec. 17, 1991 to Uwe Heitmann for "METHOD OF AND APPARATUS FOR MAKING A FILLER OF SMOKABLE MATERIAL"), or in commonly owned U.S. Pat. No. 5,526,826 (granted Jun. 18, 1996 to Uwe Heitmann for "APPARATU FOR REMOVING SURPLUS FROM A TOBACCO STREAM"). An example of numerous apparatus which are designed to utilize a continuous web of wrapping material which consists of a series of successive spliced-together discrete webs other than those utilized in a tobacco processing machine is that disclosed in commonly owned U.S. Pat. No. 5,442,897 granted Aug. 22, 1995 to Alfred Hinzmann et al. for "METHOD OF AND APPARATU FOR MAKING TUBULAR ENVELOPES".

The web 2 is trained over two spaced-apart parallel rollers 6, 8 to advance along an elongated path extending toward, through and beyond a splicing station (at the tip of the arrow 50) in the direction indicated by an arrow 22. The roller 8 deflects successive increments of the web 2 toward the processing or consuming machine wherein the web is subdivided and/or deformed (such as converted into a tubular envelope) in a manner and for the purposes not forming part of the instant invention.

When the supply of the running web 2 is about to expire (this is ascertained by a suitable detector or sensor which is not shown because it forms no part of the present invention), the trailing end of this web is spliced to the leading end of the fresh web 18 (furnished by a bobbin or reel 19 driven by a second drive means, e.g., a variable-speed electric motor M3 operated by a regulating means including or constituting the aforementioned control unit 55) after the free foremost part of the leading end of the fresh web enters the nip of and is pulled by a device 12 composed of two rollers 14, 16 at least one of which is adapted to be driven by a variable-speed electric motor M2 or another suitable prime mover or drive means in response to a signal from the control unit 55. On its way from the bobbin 19 to the nip of the rollers 14, 16, the fresh web 18 is guided by a member 20 (e.g., an idler roller) which ensures that the portions of the webs 2, 18 advancing from the roller 20 toward the roller 18 are maintained at an optimum distance from each other (e.g., immediately adjacent and at least substantially parallel to but normally out of actual contact with each other).

The means for splicing the webs 2, 18 to each other in accordance with the process and in the machine of the present invention includes a first rotary splicing member or carrier 24 at one side and a second rotary splicing member or carrier 26 at the other side of the splicing or knurling station at the tip of the arrow 50. The means for rotating the roll-shaped splicing members or carriers 24, 26 (hereinafter often called rolls for short) respectively include variable-speed prime movers or drive means M4, M6 each of which can constitute a variable-speed electric motor receiving start, stop, acceleration and/or deceleration signals from the control unit 55 in accordance with a program to be described hereinafter with reference to FIG. 1 as well as with reference to FIGS. 2*a* to 2*i*. Some or all of the motors M1 to M4 and M6 are or can be arranged to operate independently of each other.

The rolls 24, 26 are respectively rotatable about spaced-apart parallel axes 25, 35. The cylindrical peripheral surface 28 of the roll 24 carries a first arcuate segment-shaped knurling member 23 having a convex radially outermost knurling surface 27 extending along a relatively short arc of, e.g., between 25° and 35°, and the cylindrical peripheral surface 30 of the roll 26 carries a second arcuate segment-shaped knurling member 32 having a convex peripheral surface 34. The dimensions of the knurling member 23 (hereinafter also called segment) can but need not be identical with those of the knurling member or segment 32. The directions of rotation (orbiting) of the segments 23, 32 are indicated by the arrows 40 and 42, respectively.

The surface 27 is assumed to be knurled, and the surface 34 is assumed to be smooth. Such configurations of the surfaces 27 and 34 enable the segments 23, 32 to splice the web 2 to the web 18 when the control unit 55, the dimensions of the two components of the knurling tool 24, 26, 23, 32, the control unit 55 and the distance between the axes 25, 35 permit the surfaces 27, 34 to move sufficiently close to each other to not only contact the respective webs 2, 18 but to also press the webs against each other with a force that is required to carry out a splicing operation known as knurling.

It is also within the purview of the present invention to provide the segment 23 with a smooth convex surface 27 and to provide the segment 32 with a knurling surface 34, or to provide each of the segments 23, 32 with a knurling surface. All that counts is to ensure that the segments 23, 32 can splice the webs 2, 18 to each other at the exact instant when the making of a splice SP (see FIGS. 2*h* and 2*i*) is desired and necessary.

The number of motors M can be reduced, e.g., to one, if the machine of FIG. 1 employs suitable transmissions (such as belts and pulleys, chains, gear trains and/or the like) which can rotate the parts 4, 19, 12, 24 and 26 at requisite speeds, in required directions and at required intervals in response to signals from the control unit 55.

The splicing of the leading end of the fresh web 18 to the trailing end of the expiring web 2 takes place when the identical or practically identical speeds of the webs at the splicing station (at 50) are matched or closely approximated by the speeds of orbital movement of the convex surfaces 27 and 34. This takes place shortly or immediately before the remnant 52 (see FIGS. 3 and 4*c*) of the expiring web 2 reaches the splicing station. Acceleration of the leading end of the fresh web 18 to the speed of the running expiring web 2 is effected by the pair 12 of rollers 14, 16, i.e., by the motor M2 in response to a signal from the control unit 55.

The manner in which the motors M4 and M6 respectively accelerate the rolls 24, 26 (and hence the segments 23, 32) to the speeds which are required to carry out a satisfactory splicing operation is shown in FIGS. 2*a* to 2*i*. In accordance with a presently preferred embodiment, the rolls 24, 26 are accelerated in such a way that the ratio of their rotational speeds ultimately matches or approximates 10:11. Otherwise stated, the surface 27 of the segment 23 contacts the adjacent side of the web 2 simultaneously with the establishment of contact between the surface 34 of the segment 32 and the adjacent side of the web 18 during the tenth revolution of the slower roll 24. It will be appreciated that the just described ratio n=10 (i.e., n>1) is but one of several ratios which can be selected to ensure the making of a satisfactory splice SP.

Care should be taken to select the lengths of the convex surfaces 27 and 34 (as seen in the circumferential direction of the respective rolls 24, 26) in such a way that the splicing tool including the parts 24, 26, 23, 32 will be capable of making a splice SP having a desired length (as seen in the direction of the arrow 22, i.e., in the longitudinal direction of overlapping webs 2, 18 in the elongated path between the rollers 20 and 8). The spliced-together webs 2, 18 should be free to move relative to the rolls 24, 26 as soon as the making of the splice SP is completed. This is desirable in order to avoid damage to the splice, not only as concerns its appearance but also as regards its strength.

Figure 2A:
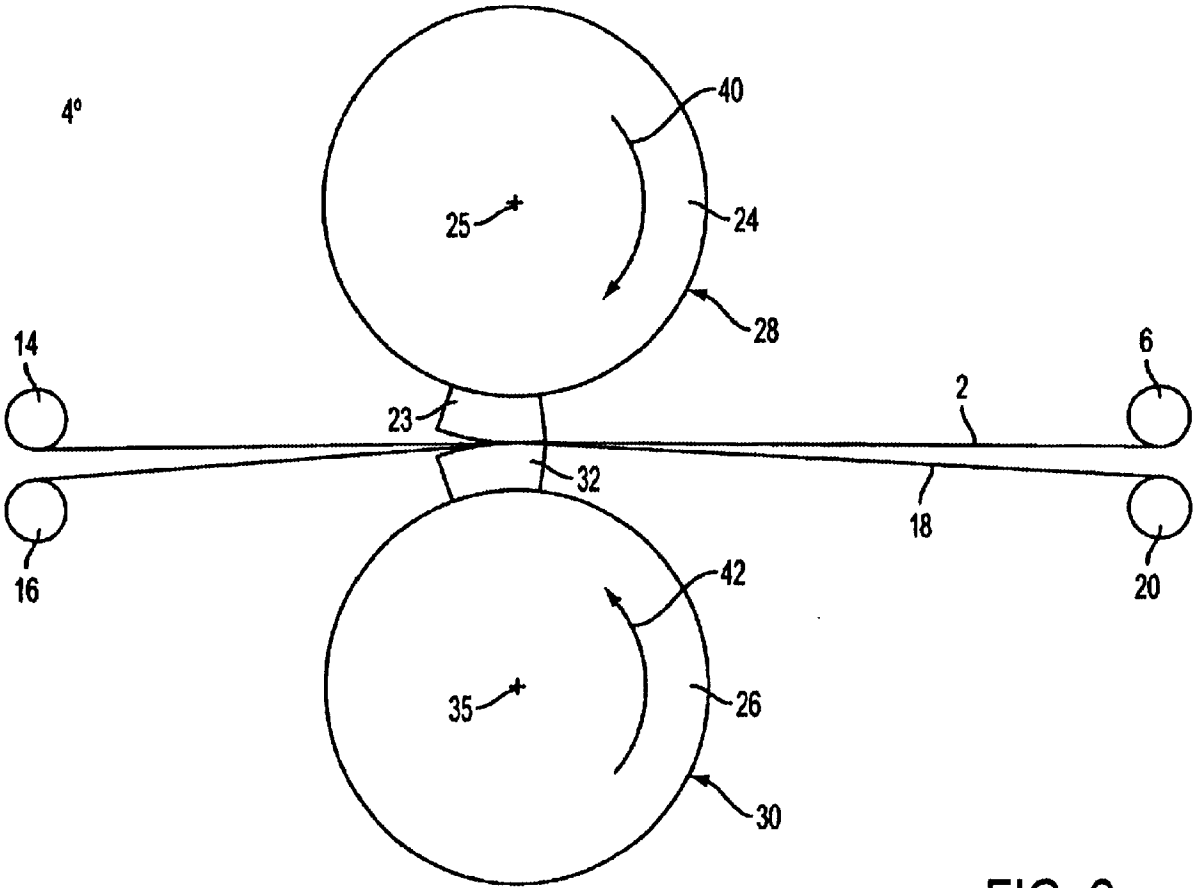
FIGS. 2*a* to 2*i* illustrate various stages of angular movement of the two knurling surfaces at the opposite sides of the path for the leading and trailing ends of the two webs.
Figure 2B:
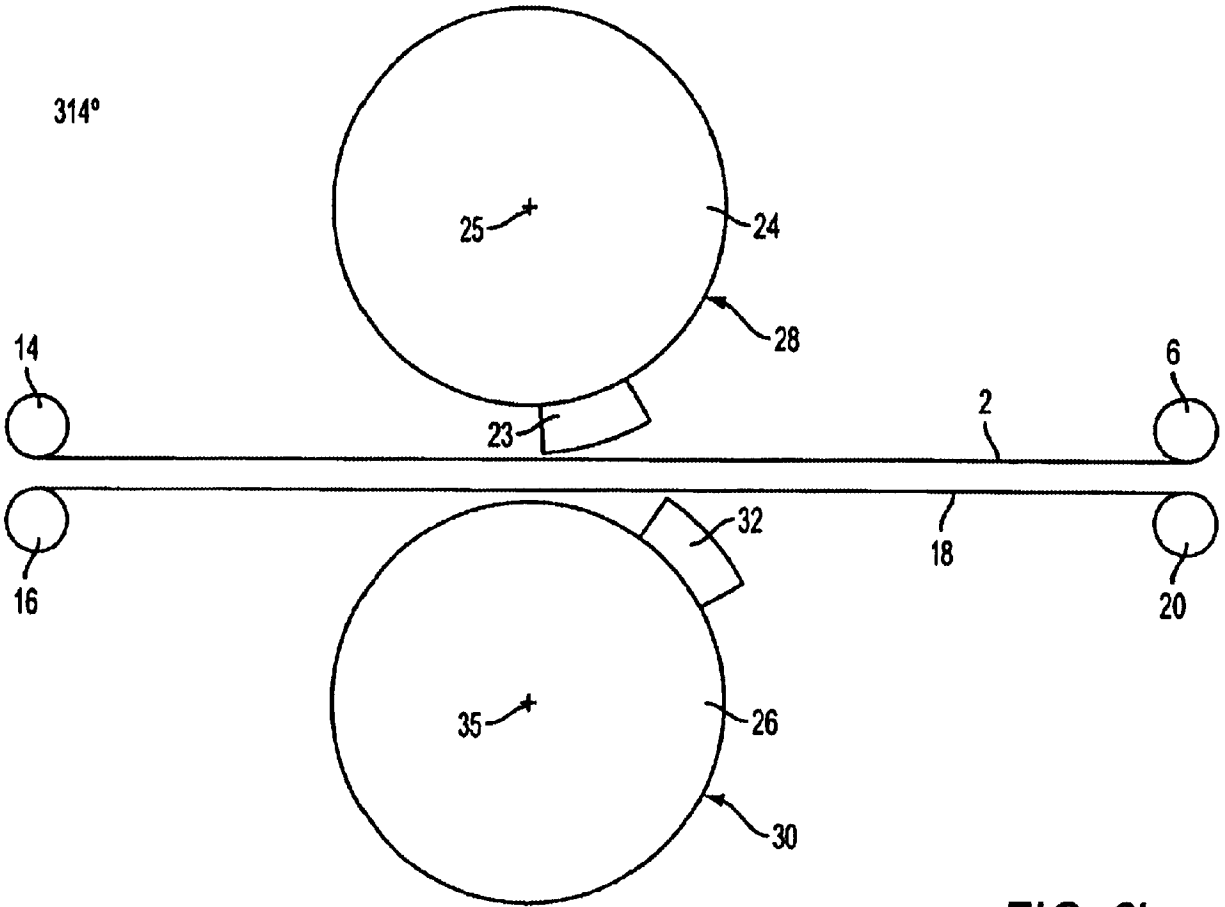
Figure 2C:
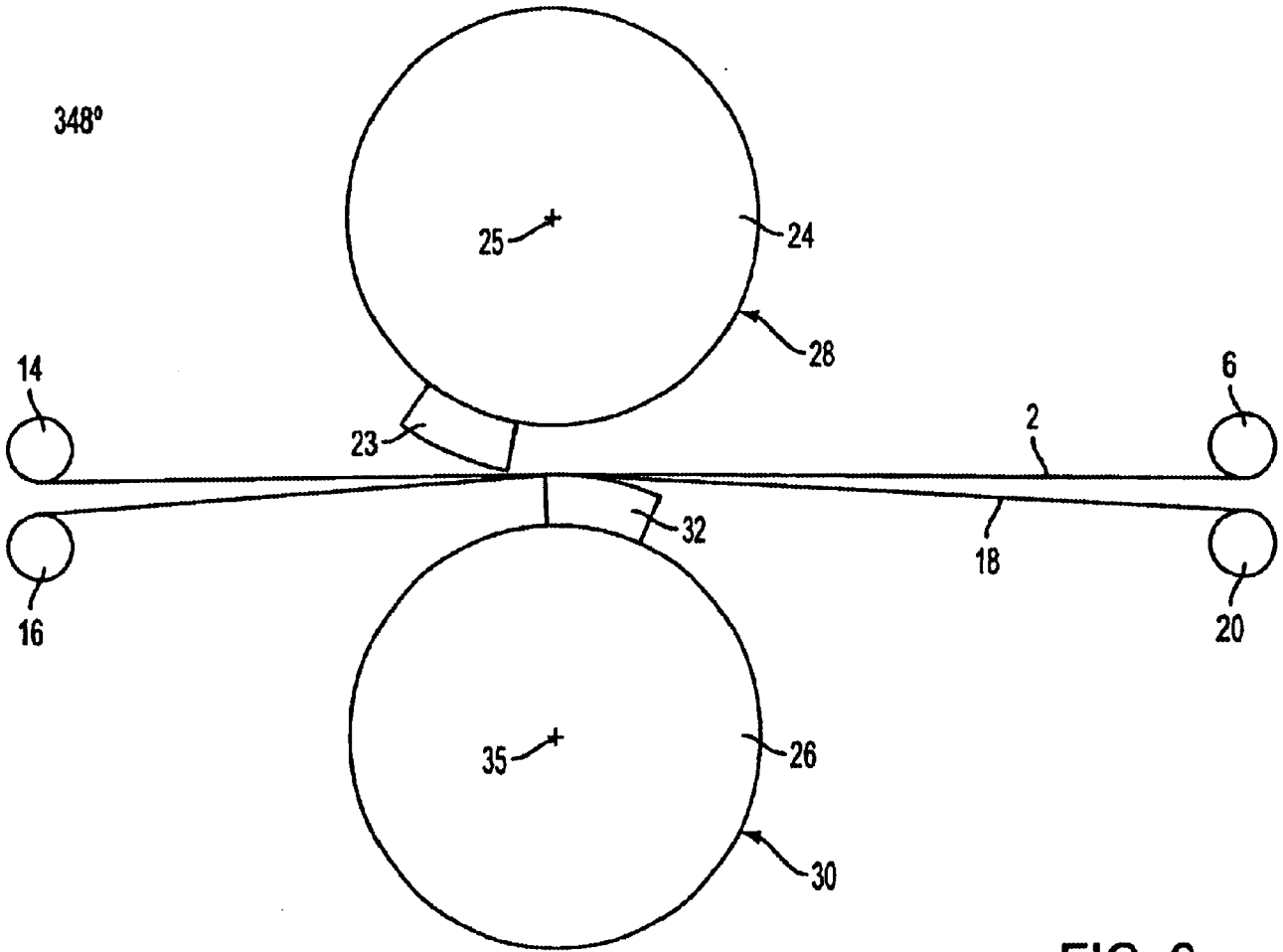
Figure 2D:
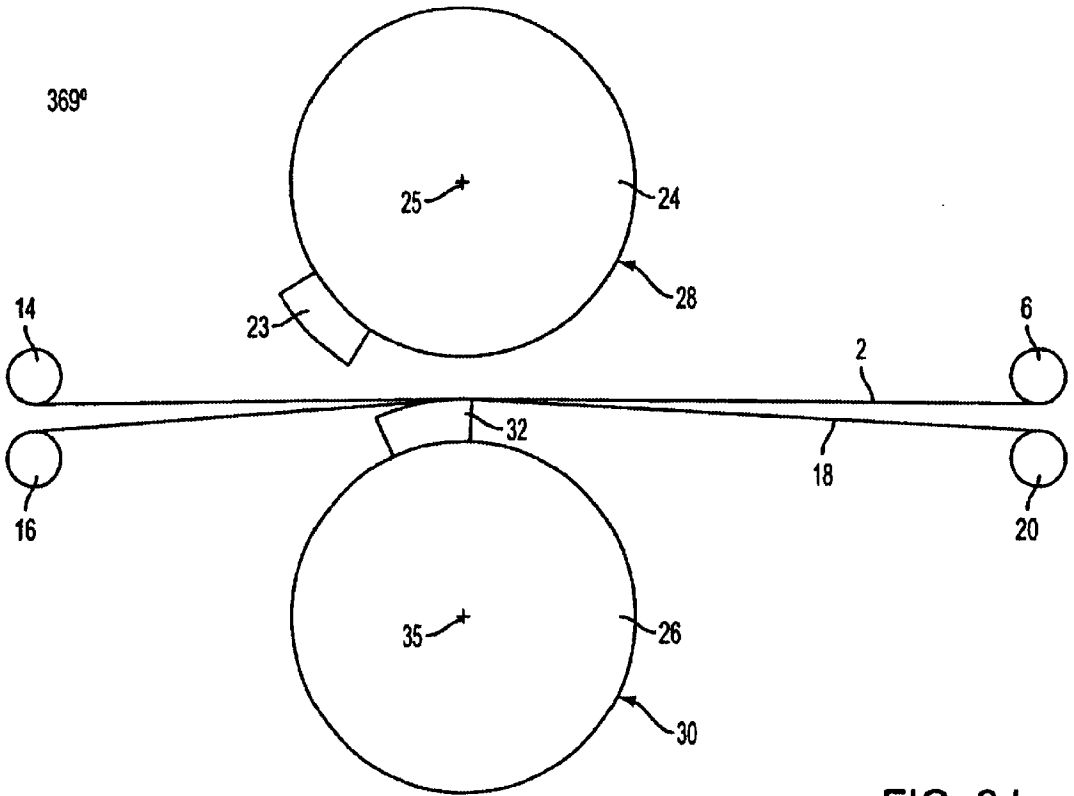
Figure 2E:
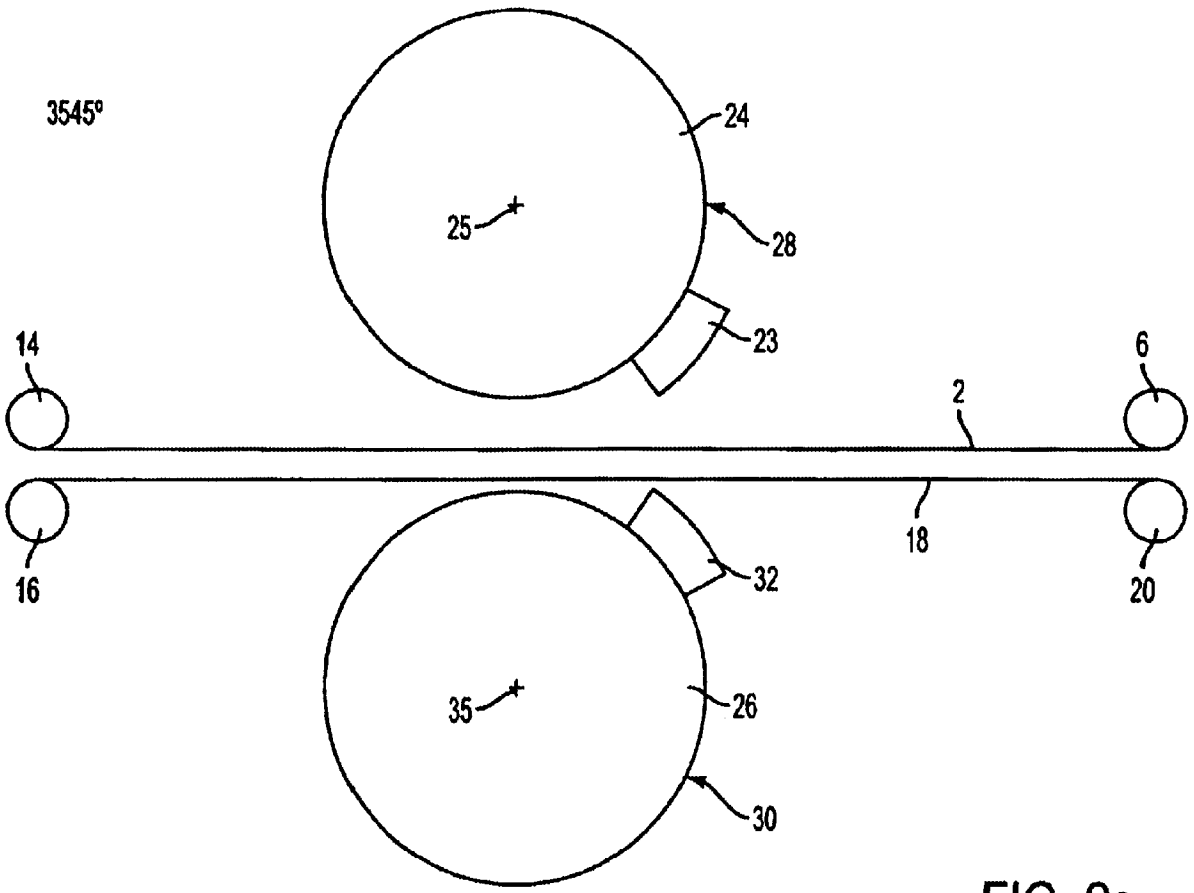
Figure 2F:
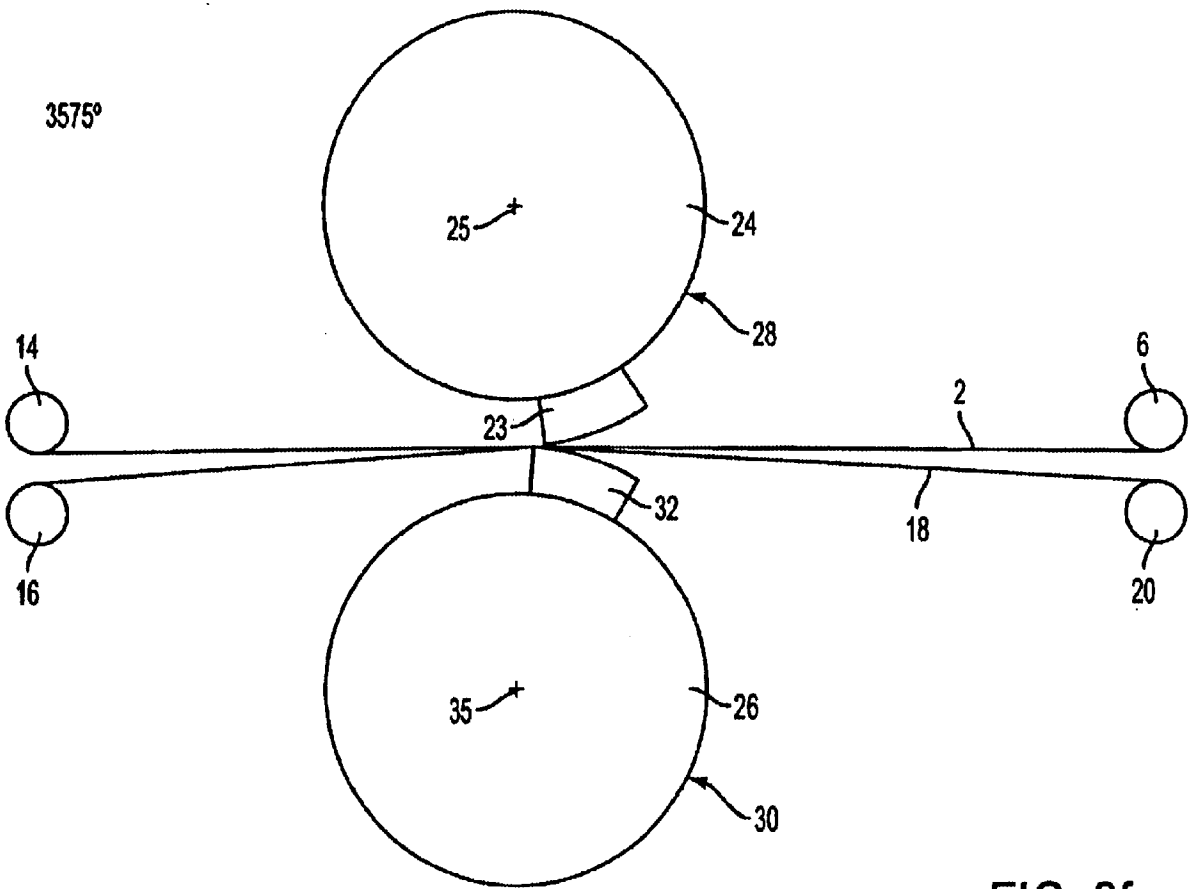
Figure 2G:
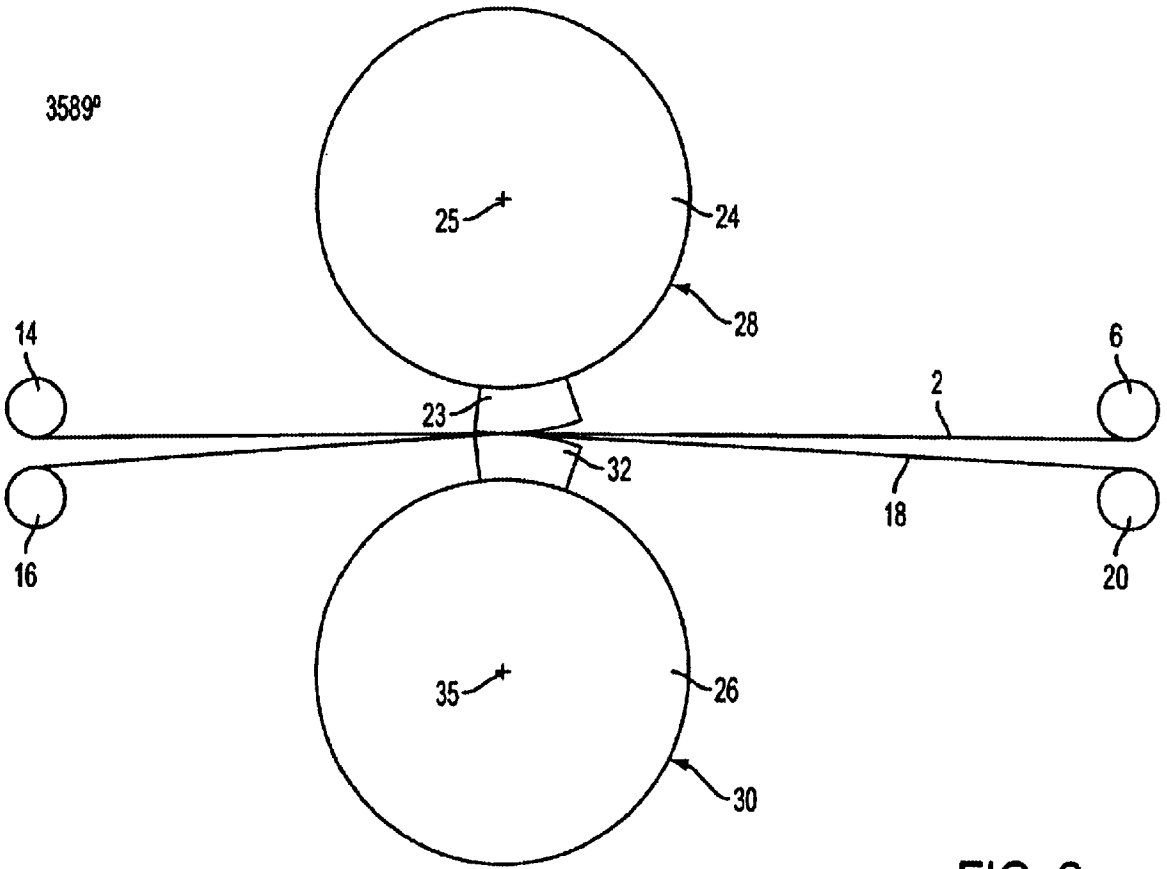
Figure 2H:
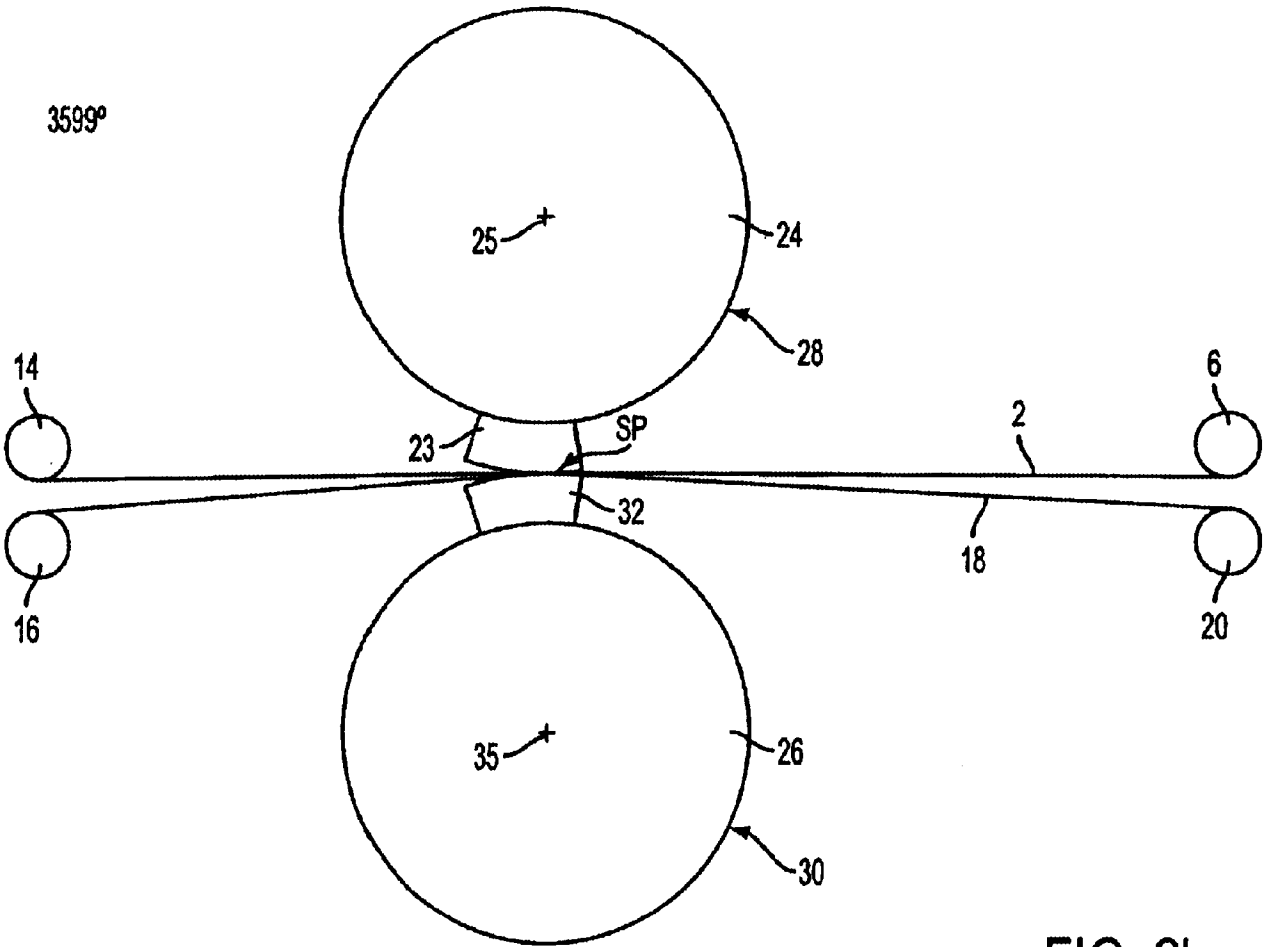
Figure 2I:
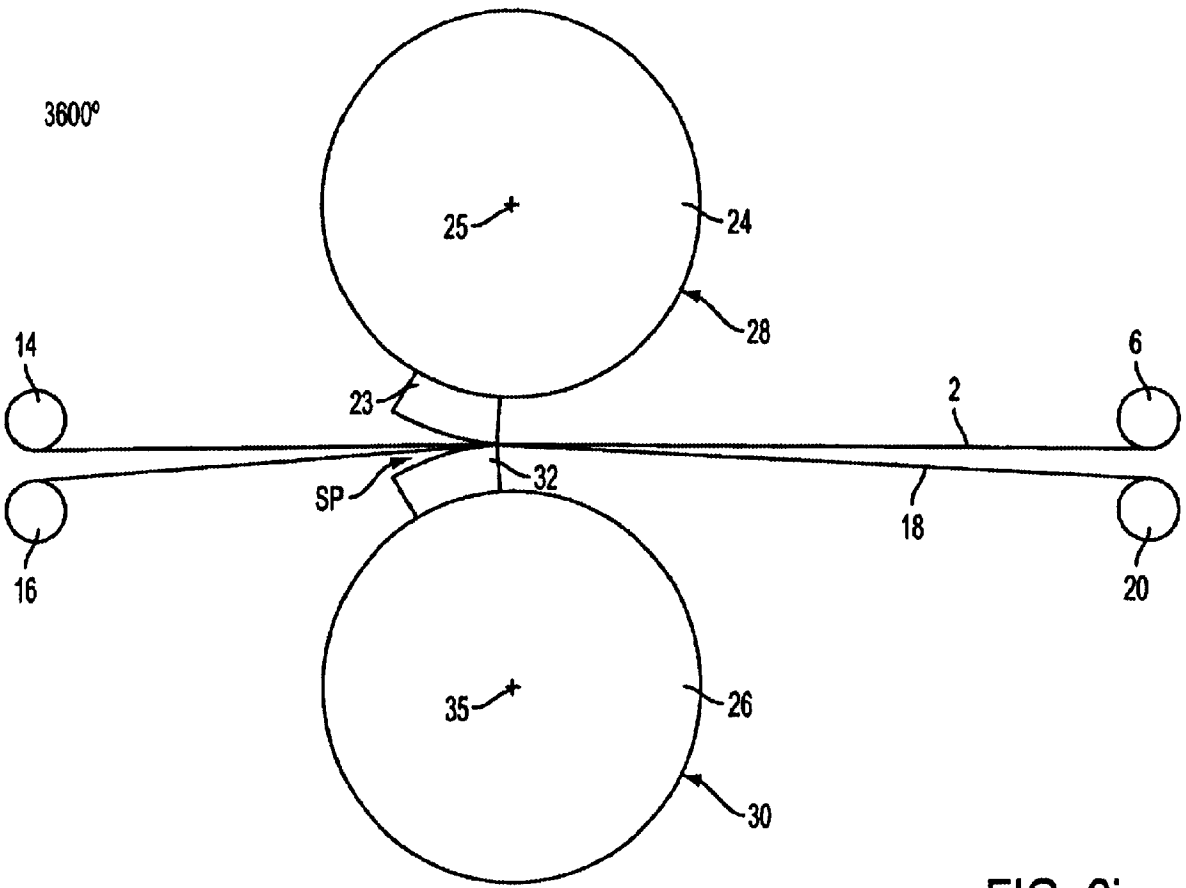

The slower roll 24 completes ten revolutions about the axis 25, and the faster roll 26 completes 11 revolutions about the axis 35 before the peripheral speed of the convex surface 27 matches or closely approximates that of the convex surface 34 as well as the speeds of the webs 2 and 18. Such matching or close approximation of the speeds of the webs 2, 18 to the speeds of the convex surfaces 27, 34 is followed by the making of a splice SP which, in turn, is followed by a deceleration of the convex surfaces 27, 34 (such as during the next-following ten revolutions of the rolls 24, 26) prior to next potential contact of the segments 23, 32 with two webs between them. FIGS. 2*a* to 2*i* illustrate the positions of the segment 23 on the roll 24 relative to an imaginary straight line connecting the axes 25 and 35. The roll 24 rotates in a clockwise direction (as indicated by the arrow 40), and the roll 26 rotates anticlockwise (see the arrow 42). FIGS. 2*b* to 2*f* show that the aforediscussed ratio of speeds of the rolls 24, 26 ensures the establishment of contact between the surfaces 27, 34 and the adjacent webs 2, 18 after the segment 23 has completed an angular movement through 3575°. As shown in FIGS. 2*g* and 2*h*, actual knurling of the webs 2, 18 takes place when the roll 24 has completed or is in the process of completing an angular movement through about 3600° from its starting position. FIG. 2*i* shows the final stage (i.e., the completion) of the making of a splice SP, i.e., the last stage of cooperation of convex surfaces 27, 34 to produce the splice by knurling the respective (overlapping) portions of the webs 2 and 18.

As already mentioned hereinbefore, the speed of at least one of the segments 23 and 32 can be regulated in such a way that the speed of orbital movement of the segment 23 about the axis 25 at least approximates the speed of orbital movement of the segment 32 about the axis 35 and the speed of the webs 2, 18 when the surfaces 27, 34 are in the process of making the splice SP. This is accomplished by appropriate selection of a servo system for the motor M4 and/or M6 and/or by resorting to an eccentrically mounted driver gear (not shown) for at least one of the rolls 24, 26 and/or in any other suitable manner.

The direction of rotation of the rolls 24, 26 is or can be reversed when the making of the splice SP between the webs 2 and 18 is completed. Such angular movements must or should be completed before the web 18 is about to expire and the expired web 2 is replaced by a new web having a leading end which is properly threaded into the path extending between the rollers 6 and 8. The rearward rotation of the rolls 24, 26 might entail the establishment of short-lasting contact between the web 18 and the smooth convex surface 34 and/or between the non-illustrated new web and the knurled convex surface 27; however, such contacts do not occur simultaneously so that the improved machine cannot make a splice at an inopportune time, i.e., when the leading end of the new web is not adjacent the trailing end of the then expiring web 18. It is preferred to effect reverse rotation of the rolls 24, 26 (i.e., counterclockwise and clockwise, respectively) in such a way that the then expiring web 18 is intermittently contacted and even slightly deflected by the smooth convex surface 34 of the segment 32 but that the knurled convex surface 27 of the segment 23 does not contact (and does not deflect) the adjacent portion of the leading end of the new web which has replaced the expired web 2. As can be seen in FIGS. 2*h* and 2*i*, the making of a splice SP can take place while the segment 32 deflects the webs 2, 18 upwardly, i.e., toward the segment 23.

An advantage of the machine which is shown in FIGS. 1 and 2*a* to 2*i* is that the provision for repeated revolutions of the rolls 24, 26 prior to the making of a splice provides ample time for acceleration of the webs 2, 18 to optimum speeds for the establishment of a reliable splice between them. Moreover, the splicing machine is highly unlikely to damage the web 2 and/or 18 and/or the new web following the web 18 because the webs 2, 18, the web 18 and the web replacing the web 2 and so forth need contact each other only and alone when they are to be spliced to each other Another important advantage of the improved splicing machine is that it is relatively simple, that it comprises a relatively small number of simple parts, and that the wear upon its parts is negligible so that it can be utilized for the splicing together of large numbers of successive webs.

Figure 3:
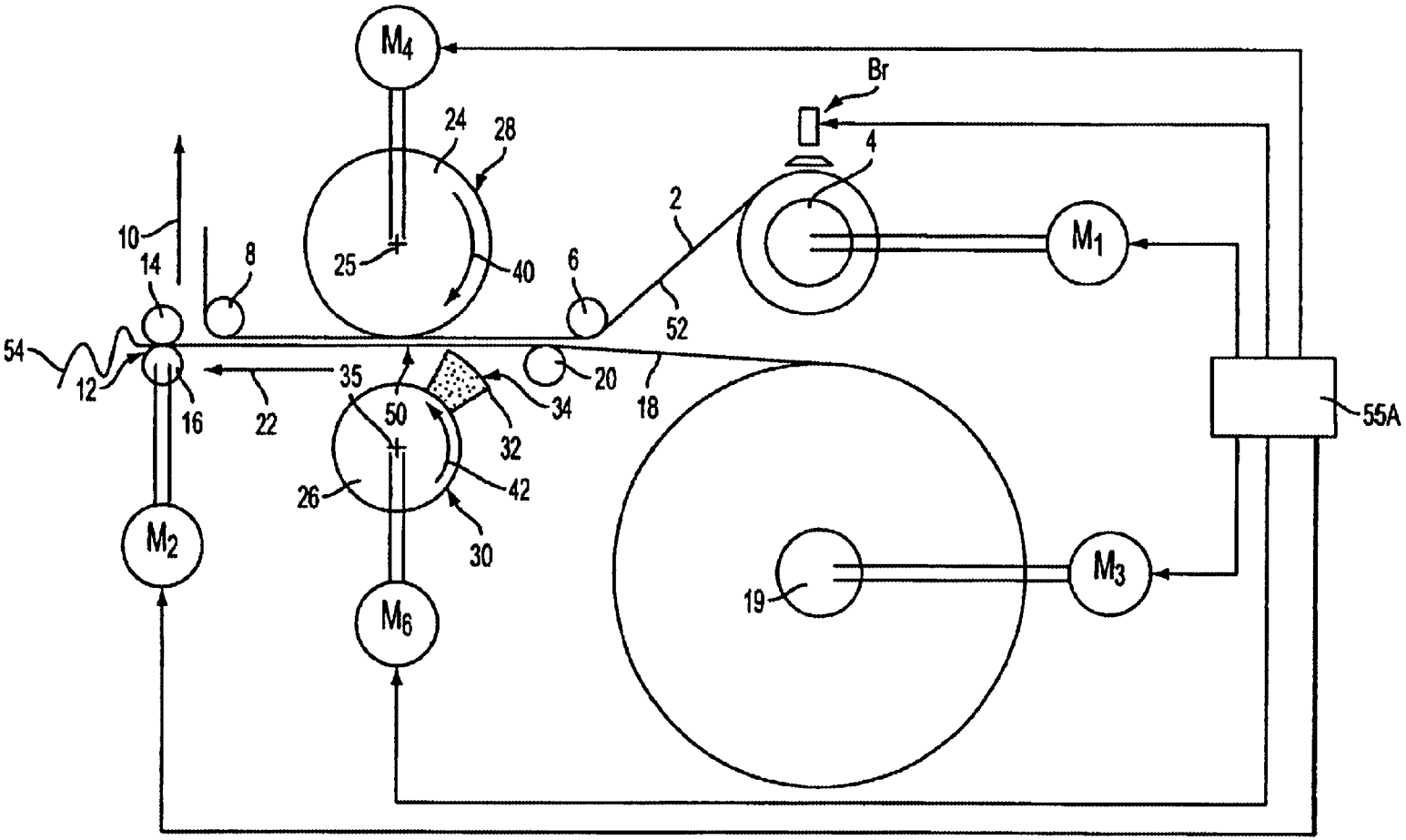
FIG. 3 is an elevational view similar to that of FIG. 1 but showing certain relevant component parts of a machine wherein the splicing of the ends of two running webs to each other is carried out by a convex knurling surface and a smooth cylindrical complementary surface.
Figure 4C:
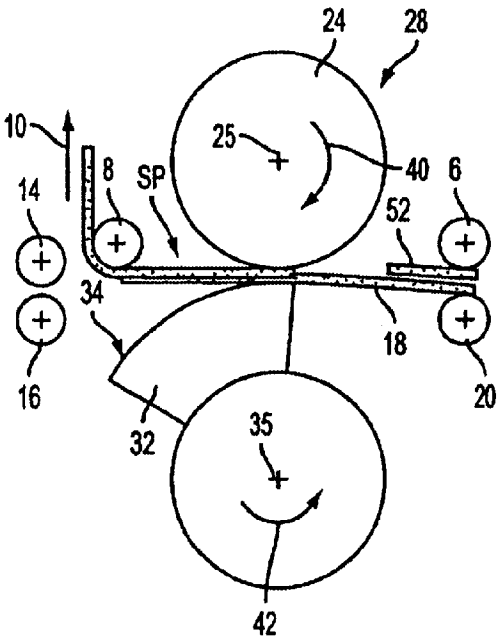
FIG. 4*c* is a view similar to that of FIG. 4*a* or 4*b* but showing the knurling surface in an angular position it assumes upon completion of a splice, a rearwardly extending remnant of the trailing end of the expired web being shown upon completed tearing away from the spliced-together webs immediately behind the splice.

FIG. 3 illustrates certain features of a modified splicing machine. All such parts of this machine which are identical with or plainly analogous to the corresponding parts of the splicing machine of FIGS. 1 to 2*i* are denoted by similar reference characters and are described herein only if their mode of operation departs from that of the corresponding parts in the machine of FIGS. 1 to 2*i*.

The roll 24 is mounted for rotation about the axis 25 and is arranged to be driven by a variable-speed reversible electric motor M4 which can receive signals from a control unit 55A. The segment 23 of FIG. 1 is omitted, and the smooth cylindrical peripheral surface 28 of the roll 24 cooperates with the knurled convex surface 34 of the arcuate segment 32 when the knurling tool including the roll 24 and the segment 32 is to splice the trailing end of the expiring web 2 to the leading end of the fresh web 18. Such splicing involves deformation of the web 18 and the establishment of a mechanical connection between the webs 2 and 18.

The distance between the axes 25, 35 of the rolls 24, 26 is selected in such a way that the making of a splice between the webs 2, 18 takes place only in a certain angular position of the segment 32 relative to the roll 24.

The control unit 55A is operatively connected with the motors M1 to M4 and M6 as well as with a brake Br for the remnant 52 (see also FIG. 4*c*) at the trailing end of the web 2 behind the splice SP. This control unit comprises a memory (not specifically shown) which stores a program for the operation of the motors and/or the brake Br in a predetermined sequence, at predetermined intervals, at predetermined speeds, for predetermined periods of time and (if necessary) as a function of other parameters which ensure operation of the machine of FIG. 3 in accordance with the present invention. The control unit 55A further comprises a microprocessor which initiates the operation of the motors M1 to M4 and M6 as well as of the brake Br in the predetermined sequence.

The speed of at least one of the rolls 24, 26 is regulated in such a way that the convex knurling surface 34 of the segment 32 on the peripheral surface 30 of the roll 26 moves in synchronism with that of the smooth peripheral surface 28 of the roll 24 when these surfaces are being called upon to make a splice SP. FIG. 3 shows the surfaces 28, 34 in angular positions they assume prior to start of the making of a splice. The making of the splice is started when the forward end of the knurled surface 34 (as seen in the direction of the arrow 42) reaches the splicing station at the tip of the arrow 50, i.e., when the surfaces 28, 34 begin to cooperate to press the adjacent portions of the webs 2, 18 against each other and to simultaneously deform at least the web 18 due to the configuration (knurling) of the surface 34.

The making of the splice SP at the station denoted by the arrow 50 normally or often begins when a (first) remnant 52 of the expiring web 2 still extends rearwardly beyond the developing splice SP and when a (second) remnant 54 of the front end of the fresh web 18 extends forwardly beyond the station denoted by the arrow 50 to an extent such that it enters the nip of and is advanced (in the direction of arrow 22) by the rollers 14, 16 of the roller pair 12. It is advisable to separate the remnant 52 and/or 54 from the spliced-together webs 2, 18 because such remnants could interfere with proper operation of the web processing or consuming (e.g., wrapping) machine (not shown) receiving successive increments of those portions of the webs 2, 18, etc. which advance in the direction of the arrow 10. The remnant 52 and/or 54 could adversely affect the quality of the product (e.g., plain cigarettes) which is turned out by the processing machine or could bring the operation of the processing machine to a halt.

Figure 4B:
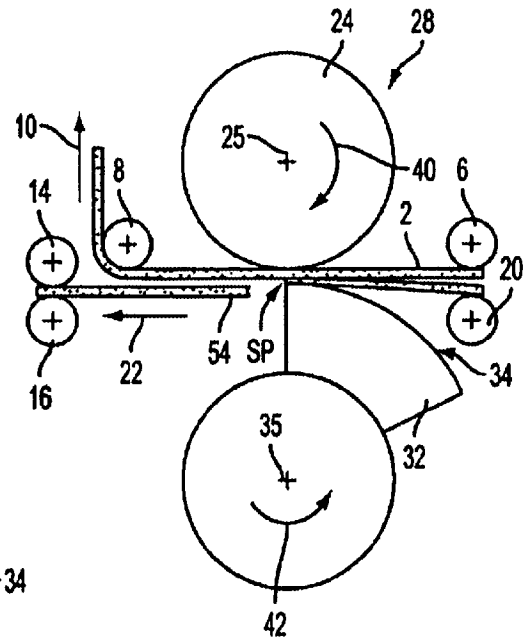
FIG. 4*b* shows the structure of FIG. 4*a* but with the knurling surface in a position it assumes at the start of a splicing operation and after two driven rollers have already separated the forwardly projecting remnant of the fresh web by tearing it away from the spliced-together webs.
Figure 4A:
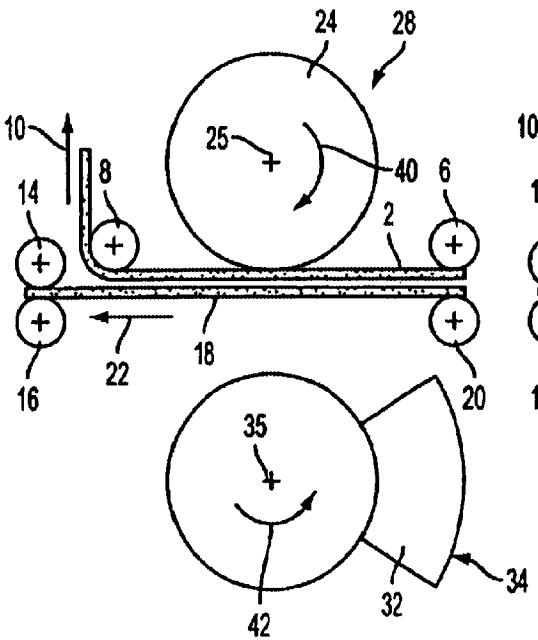
FIG. 4*a* is an enlarged view of the splicing station in the machine of FIG. 3, showing the knurling surface in a position remote from the path for the webs.

FIG. 4*a* shows the forwardly extending remnant 54 in the nip of the rollers 14, 16 but prior to its separation from the major part of the fresh web 18. The motor M2 of FIG. 3 starts to rotate the rollers 14, 16 at a speed which is required to tear the remnant 54 from the major part of the web 18 subsequent to start of the making of the splice SP (see FIG. 4*b*) because the making of such splice weakens the web 18 and, therefore, the rollers 14, 16 can tear the remnant 54 of the web 18 along the transversely extending front end of the developing or completed splice. The peripheral speeds of the rollers 14, 16 need not greatly exceed the forward speed of the splice SP (i.e., of the major part of the web 18 and of the trailing part of the web 2 ahead of the remnant 52), as long as such peripheral speeds suffice to overcome the tensile strength of the weakened part of the web 18 immediately ahead of or at the forward end of the freshly formed splice. The rollers 14, 16 can deliver the separated remnant 54 into a collecting receptacle, not shown.

In order to tear the remnant 52 off the web 2 at the rear end of the freshly completed splice SP, the control unit 55A actuates the brake Br which engages the web 2 at the core of the bobbin 4. This decelerates the remnant 52 and tears it off the preceding part of the web 2 along the rear end portion of the splice SP (see FIG. 4*c*). The braking action of the device Br must suffice to overcome the tensile strength of the weakened portion of the web 2 at the trailing end of the completed or practically completed splice between the webs 2 and 18.

An advantage of the separating means for the remnants 52 and 54 is that they need not employ any knives or analogous implements which necessitate repeated resetting, sharpening and/or replacement. Moreover, the remnants can be torn off directly adjacent the respective ends of the splice SP so that the splice cannot entrain any surplus web material into the machine which processes the webs 2, 18 and so forth.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of splicing running webs of paper and the like and, therefore, such adaptations should and are intended to be comprehended within the meaning and range of equivalence of the appended claims.

What is claimed is:

1. A process for splicing the trailing end of an expiring running web to the leading end of a fresh running web, comprising the steps of:

advancing the leading and trailing ends in at least substantial parallelism with and next to each other at an at least substantially identical speed along a path flanked by a rotary knurling surface and a rotary countersurface; and rotating said surfaces at different speeds through at least a majority of a plurality of revolutions, said revolutions including an n-th revolution during which the surfaces are sufficiently close to each other to splice the trailing end to the leading end in said path, n being greater than one.

2. The process of claim 1, wherein said rotating step includes maintaining the speeds of said surfaces at least close to said substantially identical speed in the course of said n-th revolution.

3. The process of claim 1, wherein n is at least close to ten revolutions.

4. The process of claim 1, wherein the ratio of said different speeds at least approximates 10:11.

5. The process of claim 1, further comprising the step of bringing one of the surfaces into contact with one of the webs in said path only in the course of said n-th revolution.

6. The process of claim 5, wherein the one surface is the knurling surface.

7. The process of claim 1, wherein said rotating step further includes rotating the surfaces at an at least substantially identical speed in the course of said n-th revolution.

8. The process of claim 1, wherein said rotating step entails the provision of at least one remnant which develops in the course of said n-th revolution and is of one piece with one of the webs, and further comprising the step of separating the at least one remnant from the spliced-together webs.

9. The process of claim 8, wherein said separating step includes moving the at least one remnant at a speed other than said at least substantially identical speed.

10. The process of claim 9, wherein said rotating step entails the provision of a remnant of the expiring web and said separating step includes reducing the speed of the remnant below said at least substantially identical speed.

11. The process of claim 10, wherein said speed reducing step includes braking the remnant of the expiring web.

12. The process of claim 9, wherein said rotating step entails the provision of a remnant of the fresh web and said separating step includes accelerating the remnant above said at least substantially identical speed.

13. The process of claim 12, wherein said accelerating step is carried out during one of the stages including (a) simultaneously with splicing of the webs to each other and (b) subsequent to the splicing.

14. A machine for splicing the trailing end of an expiring running web to the leading end of a fresh running web while the leading and trailing ends advance next to each other, in the same direction and at an at least substantially identical speed, comprising;

a rotary knurling member adjacent one side of the path;

a rotary splicing member adjacent the other side of the path at least substantially opposite said knurling member;

regulatable drive means for said rotary members; and means for regulating said drive means to rotate said members at different speeds through at least a majority of a plurality of revolutions, said revolutions including an n-th revolution during which said members are sufficiently close to each other to splice the trailing end to the leading end in the path, n being greater than one.

15. The machine of claim 14, wherein said knurling member has a peripheral knurling surface and said splicing member has a peripheral countersurface cooperating with said knurling surface to splice the leading and trailing ends of the webs in the path to each other in the course of said n-th revolution of said plurality of revolutions.

16. The machine of claim 15, wherein said drive means includes means for rotating said members about spaced-apart at least substantially parallel axes.

17. The machine of claim 16, wherein at least one of said members includes a segment arranged to orbit about the respective axis.

18. The machine of claim 17, wherein said means for rotating includes a roll rotatable about the respective axis and having a peripheral surface bearing said segment.

19. The machine of claim 16, wherein said means for rotating includes two rolls each rotatable about a different one of said axes, said knurling member including a first segment borne by one of said rolls and said splicing member including a second segment borne by the other of said rolls.

20. The machine of claim 19, wherein said axes are spaced apart from each other a distance which is required to ensure that said segments compress the webs in the path and thus splice the webs to each other only during said n-th revolution of said plurality of revolutions.

21. The machine of claim 14 for splicing the trailing end of an expiring running web to the leading end of a fresh running web wherein at least one of the webs includes a remnant extending beyond the spliced-together portions of the webs in the path, further comprising means for separating the remnant from the at least one web not later than upon completed splicing of the webs to each other.

22. The machine of claim 21, wherein said separating means includes means for tearing the remnant from the at least one web.

23. The machine of claim 22, wherein said means for tearing includes means for changing the speed of the remnant and of the spliced-together portions of the webs relative to each other.

24. The machine of claim 23, wherein each of said members has a knurling surface.

25. The machine of claim 23, wherein said drive means comprises a rotary roll for each of said members.

26. The machine of claim 25, wherein said rolls are rotatable about at least substantially parallel axes.

27. The machine of claim 25, wherein at least one of said rolls has a peripheral surface and the member borne by said at least one roll includes a segment provided on said peripheral surface.

28. The machine of claim 23, wherein the remnant forms a rearwardly extending part of the trailing end of the expiring web and said speed changing means includes a brake operable by said regulating means to decelerate the remnant not later than upon splicing of the leading and trailing ends of the webs to each other.

29. The machine of claim 23, wherein the remnant forms a forwardly projecting part of the leading end of the fresh web, said speed changing means including means for raising the speed of the remnant relative to the spliced-together ends of the webs.

30. The machine of claim 29, wherein said speed changing means forms part of a means for advancing the webs in said direction.

* * * * *